US006536942B1

(12) United States Patent
Kotanagi

(10) Patent No.: US 6,536,942 B1
(45) Date of Patent: Mar. 25, 2003

(54) ALARM ELECTRONIC TIMEPIECE

(75) Inventor: Susumu Kotanagi, Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 08/926,891

(22) Filed: Sep. 10, 1997

(51) Int. Cl.[7] ..... G04B 29/00
(52) U.S. Cl. ..... 368/322
(58) Field of Search ..... 368/320–323, 368/257–271

(56) References Cited

U.S. PATENT DOCUMENTS 4,127,984 A * 12/1978 Ogihara et al. ..... 368/322

FOREIGN PATENT DOCUMENTS

| | | | | |
|---|---|---|---|---|
| CH | 330190 | * | 5/1956 | ..... 368/322 |
| CH | 338146 | * | 6/1959 | ..... 368/322 |
| FR | 953708 | * | 12/1949 | ..... 368/322 |

* cited by examiner

*Primary Examiner*—Bernard Roskoski
(74) *Attorney, Agent, or Firm*—Adams & Wilks

(57) ABSTRACT

An alarm electronic timepiece has a base member, an alarm indicator wheel supported on the base member for rotation, an an indicating member integrally connected to the alarm indicator wheel for rotation therewith to indicate alarm time. A spring member supports the alarm indicator wheel on the base member and regulates a rotation direction of the alarm indicator wheel. The spring member is integrally connected to the base member.

30 Claims, 4 Drawing Sheets

ALARM ELECTRONIC TIMEPIECE

BACKGROUND OF THE INVENTION

The present invention relates to an alarm electronic timepiece having an alarm indicator wheel holding structure.

In a conventional alarm indicator wheel holding structure, as shown in FIG. 5, a regulating face 21*a* of an alarm indicator spring 21 is pressed against a tooth form 20*a* of an alarm indicator wheel 20 by the spring force of the alarm indicator spring 21, which is a spring member with a shape for regulating the tooth form of the alarm indicator wheel 20, by which the positioning in the rotation direction is done.

The conventional alarm indicator wheel holding structure has the following problems:

(1) The regulating force cannot be made higher than the strength of tooth form because the tooth form of the alarm indicator wheel is regulated by a spring member.

(2) The regulating force for the alarm indicator wheel has a limitation, and the primary moment of an alarm hand is limited for the prevention of false indications caused by a shock due to dropping etc., so that a hand with an easy-to-see shape cannot be installed.

(3) When the tooth form of the alarm indicator wheel is regulated, the minimum setting unit of the alarm is limited.

SUMMARY OF THE INVENTION

The present invention provides an alarm electronic timepiece in which the alarm indicator wheel structure is simple and easy to assemble, and moreover, an alarm indicator wheel rotational position shift preventing means, which produces a large regulating force, is provided. Thus, by producing a large regulating force on an alarm indicator wheel, the critical primary moment of an alarm hand can be enlarged, and an alarm hand of an easy-to-see size can be installed, by which a hand shape of an excellent design can be provided.

DETAILED DESCRIPTION OF THE PREFERRED EMBODIMENTS

In the alarm hand holding structure in accordance with the present invention, an alarm indicator wheel is arranged at the outer periphery of an hour wheel, which is carried by a center pipe driven in a main plate, on the dial side of movement, the alarm indicator wheel is supported by a spring member, and the alarm indicator wheel rotational position shift preventing means is provided.

The aforesaid alarm indicator wheel rotational position shift preventing means supports the alarm indicator wheel and regulates the rotation thereof by two leaf springs in contact with the side face of the alarm indicator wheel with a spring force.

Also, a window is formed in the leaf spring, a portion at which the leaf spring slides is provided at the outer periphery of the alarm indicator wheel, and the leaf spring is installed so that the window of the leaf spring is in contact.

Figure 1:
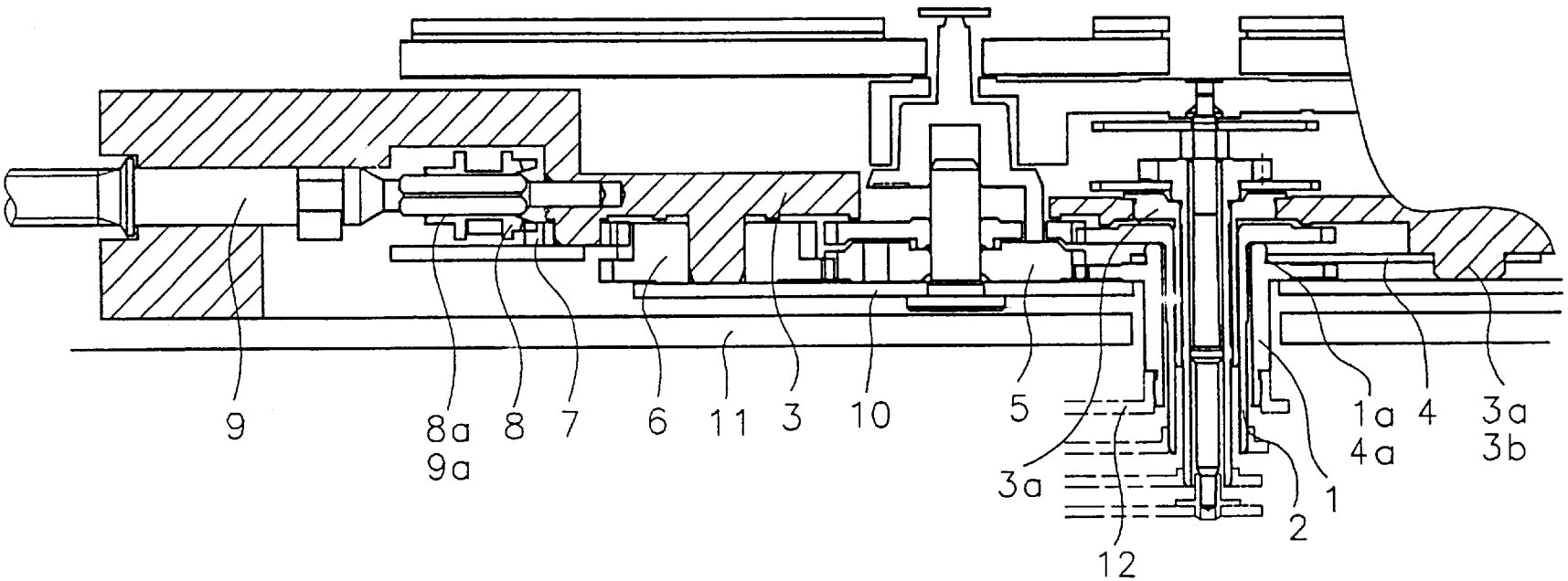
FIG. 1 is a sectional view of an alarm indicator wheel holding structure for an alarm electronic timepiece in accordance with the present invention.
Figure 2:
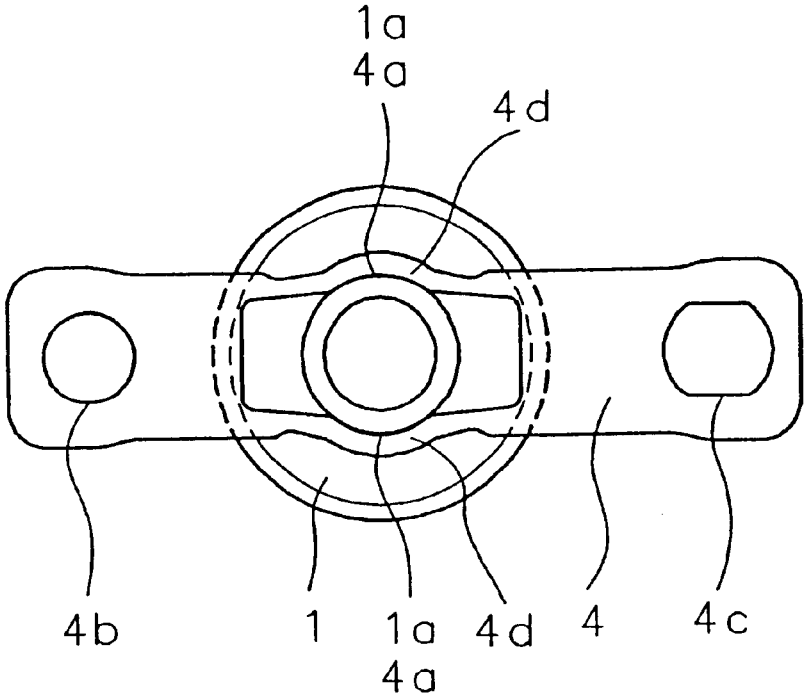
FIG. 2 is a plan view of an alarm indicator wheel for an alarm electronic timepiece in accordance with the present invention.
Figure 3:
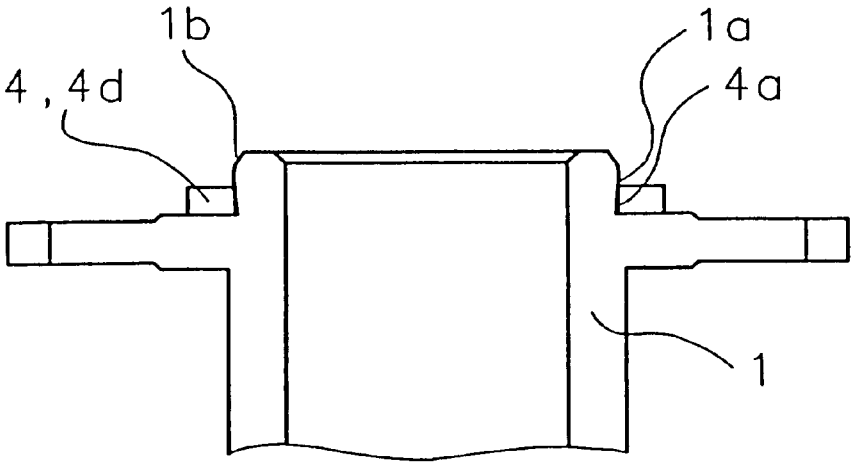
FIG. 3 is a sectional view of an alarm indicator wheel for an alarm electronic timepiece in accordance with the present invention.
Figure 4:
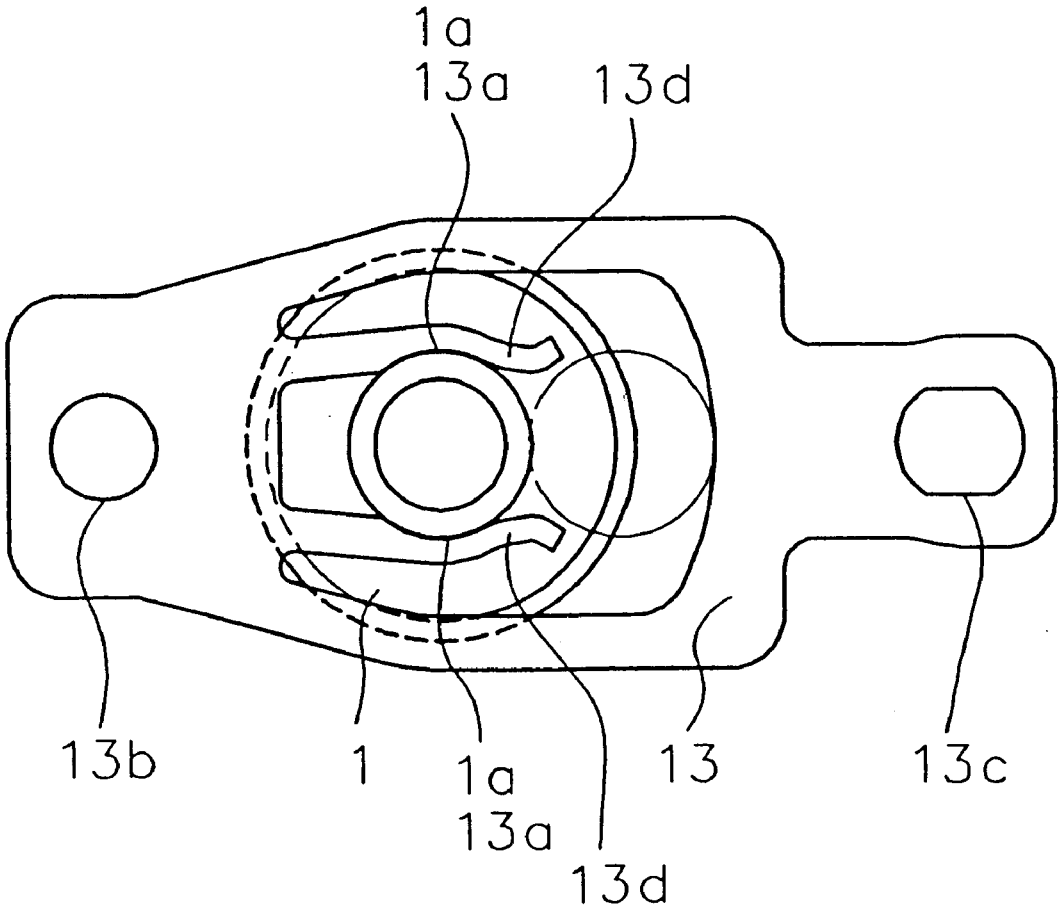
FIG. 4 is a plan view of an alarm indicator wheel having an alarm indicator spring with a different shape for an alarm electronic timepiece in accordance with the present invention.
Figure 5:
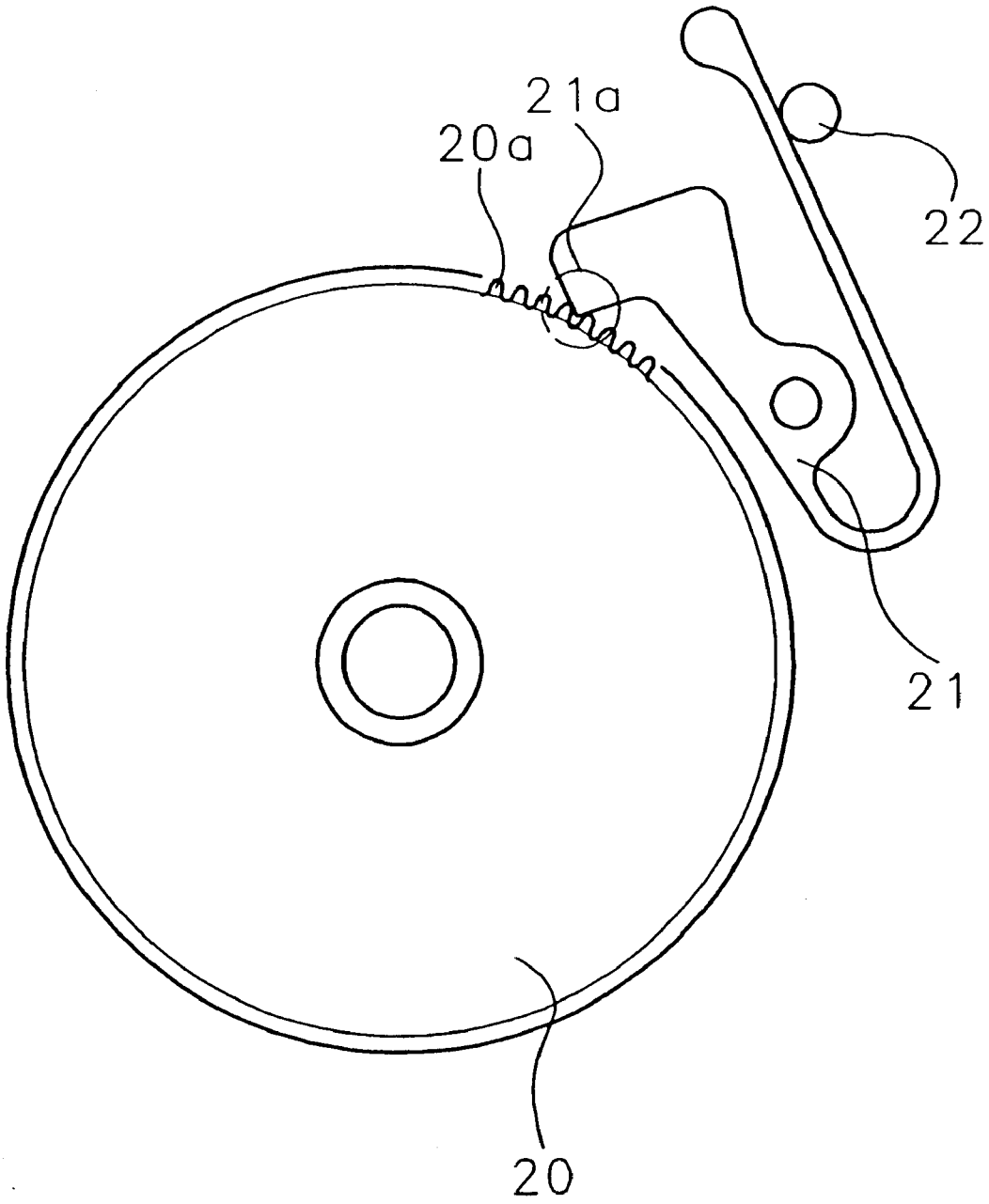
FIG. 5 PRIOR ART
FIG. 5 is a plan view of a conventional alarm indicator wheel positioning structure.

Embodiments will be described with reference to the accompanying drawings. FIG. 1 is a sectional view of an alarm indicator wheel holding structure for an alarm electronic timepiece in accordance with one embodiment of the present invention. FIG. 2 is a plan view of an alarm indicator wheel for an alarm electronic timepiece in accordance with the present invention. FIG. 3 is a sectional view of an attaching portion of the alarm indicator wheel and alarm indicator spring for an alarm electronic timepiece in accordance with the present invention. FIG. 4 is a plan view of an alarm indicator wheel having an alarm indicator wheel with a different shape for an alarm electronic timepiece in accordance with the present invention.

In FIGS. 1 and 2, reference numeral 1 denotes an alarm indicator wheel provided with an alarm hand 12, and 2 denotes an hour wheel to which a driving force is transmitted from a not illustrated back wheel. Reference numeral 3 denotes a main plate through which a center pipe 3*a* for guiding the hour wheel is driven. Reference numeral 4 denotes a spring memmber (hereinafter referred to as alarm indicator spring)for supporting a sliding portion la of the alarm indicator wheel 1. Reference numeral 5 denotes an alarm wheel for setting the operation of alarm contact and alarm time. Reference numeral 6 denotes an alarm indicator driving wheel, and 7 denotes an alarm setting wheel for transmitting a rotational force to the alarm wheel 5 when alarm time is corrected. Reference numeral 8 denotes an alarm clutch wheel, and 9 denotes an alarm winding stem. The alarm clutch wheel 8 is rotated by the rotation of the alarm winding stem 9 because a corner portion 9*a* of the alarm winding stem and a corner portion 9*a* of the alarm clutch wheel are engaged with each other. Since the alarm clutch wheel 8 engages with the alarm setting wheel 7, a rotational force is transmitted to the alarm indicator driving wheel 6, and the alarm wheel 5 is rotated, by which alarm time is set. The alarm indicator wheel 1, which engages with the alarm wheel 5, indicates alarm time on the face of a dial 11 by means of the alarm hand 12. The alarm indicator spring 4 is positioned by engaging pins 3*a* and 3*b* provided on the main plate 3 with holes 4*b* and 4*c* of the alarm indicator spring 4. The hole 4*b* formed at one end of the alarm indicator spring 4 is a round hole, and the hole 4*c* formed on the other end is an elongated hole. This configuration is used to overcome the difficulty in assembling the alarm indicator wheel 1 with the alarm indicator spring 4, which is caused by the shift of a center distance of the holes 4*b* and 4*c* of the alarm indicator spring and the pins 3*a* and 3*b* provided on the main plate. The alarm indicator wheel 1 is supported in the crosssectional direction by being pressed slidably by a support for dial side parts 10, which is fixed to the main plate 3 by screwing etc. The sliding portion 1*a* of the alarm indicator wheel provided at the end of the alarm indicator wheel 1 and an arcuate sliding portion 4*a* of the alarm indicator spring are in contact with each other by holding an elastic force, and the rotation direction of the alarm indicator wheel 1 is regulated by the elastic force caused by this contact. Also, the arcuate sliding portion 4*a* of the alarm indicator spring 4 is formed so that the contact portion engaging with the sliding portion 1*a* of the alarm indicator wheel 1 faces the intermediate portion of two bridge elements or portions 4*d* which connect with both ends of the alarm indicator spring 4, by which a support is enabled by playing a role of the rotating shaft of the alarm indicator wheel 1. Thereby, a clearance can be formed between the outer periphery of the hour wheel 2 and the inner periphery of the alarm indicator wheel 1. Therefore, the alarm indicator wheel 1 can be rotated without the contact of the outer periphery of the hour wheel 2 with the inner periphery of the alarm indicator wheel 1. When the arcuate sliding portion 4*a* of the alarm indicator spring 4 becomes eccentric, a shift of the rotating shaft of the alarm indicator wheel 1 occurs, but the inner periphery of the alarm indicator wheel 1 and the outer periphery of the hour wheel 2 do not come in contact with each other because of the clearance formed between the outer periphery of the hour wheel 2 and the inner periphery of the alarm indicator wheel 1, so that a load is not given to the hour wheel 2. Accordingly, the present invention is configured so that since a rotational load is not given to the wheel train connecting with the hour wheel, the operation of the hour indicating hand is not affected.

In FIG. 3, the end of the alarm indicator wheel 1 is provided with an alarm indicator spring attaching portion 1*a* of an inverse cone shape, which contacts with and slidably holds the arcuate sliding portion 4*a* of the alarm indicator spring 4 by an elastic force. To assemble the alarm indicator spring 4, the arcuate sliding portion 4*a* of the alarm indicator spring 4 is pushed by being guided by a slant face portion 1*b* of the alarm indicator wheel 1. The pushed alarm indicator spring 4 is integrally held so as to be slidable by the elastic force of two bridge portions 4*d* connecting with each end of the alarm indicator spring 4 and the alarm indicator spring attaching portion 1*a* of an inverse cone shape, which is provided at the end of the alarm indicator wheel 1.

In an embodiment shown in FIG. 4, a spring portion of an alarm indicator spring 13 is formed in a cantilever shape and comprises a pair of arm portions 13*d*, considering the assembling property of the alarm indicator spring 13. For example, the alarm indicator wheel 1 is placed at a position indicated by the two-dot chain line, and is assembled by moving transversely until engaging with an arcuate sliding portion 13*a* of the alarm indicator spring 13, which slides with the alarm indicator spring attaching portion 1*a* of an inverse cone shape, provided at the end of the alarm indicator wheel 1. Thereby, the alarm indicator wheel 1 and the alarm indicator spring 13 are integrally held so as to be slidable.

When the alarm indicator wheel 1 with the alarm indicator spring 13 is assembled to the main plate 3, it is positioned by engaging pins 3*a* and 3*b* provided on the main plate 3 with holes 13*b* and 13*c* in the alarm indicator spring 13.

According to the present invention, in the alarm indicator wheel holding structure for an alarm electronic timepiece, since the alarm indicator wheel and the spring member for regulating the rotational position are integrated with each other, not only the alarm indicator wheel can easily be assembled to the main plate as the alarm indicator wheel with the alarm indicator spring, but also an alarm indicator holding torque can be secured reliably and sufficiently. Therefore, the primary moment of the alarm hand can be enlarged, and an easy-to-see hand shape can be provided.

What is claimed is:

1. In an alarm electronic timepiece:

a base member, an alarm indicator wheel supported on the base member for rotation and having a generally inverse cone-shaped end portion, and a spring member for elastically supporting the alarm indicator wheel on the base member by an elastic force of the spring member, wherein the spring member has positioning holes dispersed at opposite end portions thereof for positioning the spring member on the base member, and an arcuate portion for sliding engagement with the inverse cone-shaped end portion of the alarm indicator wheel.

2. An alarm electronic timepiece as claimed in claim 1; wherein the spring member has a pair of bridge elements connecting the end portions of the spring member to one another, the arcuate portion of the spring member being disposed at an intermediate portion of the bridge elements.

3. In an alarm electronic timepiece:

a base member, an alarm indicator wheel supported on the base member for rotation and having a generally inverse cone-shaped end portion, and a spring member for elastically supporting the alarm indicator wheel on the base member by an elastic force of the spring member, wherein the spring member has opposite end portions, a pair of bridge elements connecting the opposite end portions to one another, an arcuate portion for sliding engagement with the inverse cone-shaped end portion of the alarm indicator wheen and disposed at an intermediate portion of the bridge elements, and positioning holes disposed at the opposite end portions for positioning the spring member on the base member, one of the positioning holes disposed at one of the end portions of the spring member having a generally circular shape, and another of the positioning holes disposed at the other end portion of the spring member having a generally elongate shape.

4. An alarm electronic timepiece as claimed in claim 2; wherein the end portions, the arcuate portion and the bridge elements of the spring member define a hole through which the end portion of the alarm indicator wheel extends.

5. An alarm electronic timepiece as claimed in claim 2; wherein the end portions, the arcuate portion and the bridge elements of the spring member are composed of a single piece of material.

6. An alarm electronic timepiece as claimed in claim 1; wherein the spring member has a pair of flexible arm portions extending from one of the end portions of the spring member, the flexible arm portions having arcuate surfaces defining the arcuate portion of the spring member.

7. In an alarm electronic timepiece:

a base member, an alarm indicator wheel supported on the base member for rotation and having a generally inverse cone-shaped end portion, and a spring member for elastically supporting the alarm indicator wheel on the base member by an elastic force of the spring member, wherein the spring member has opposite end portions, an arcuate portion for sliding engagement with the inverse cone-shaped end portion of the alarm indicator wheel, a pair of flexible arm portions extending from one of the opposite end portions of the spring member and having arcuate surfaces defining the arcuate portion of the spring member, and positioning holes disposed at the opposite end portions for positioning the spring member on the base member, one of the positioning holes disposed at one of the end portions of the spring member having a generally circular shape, and another of the positioning holes dispersed at the other end portion of the spring member having a generally elongate shape.

8. An alarm electronic timepiece as claimed in claim 6; wherein the flexible arm portions comprise leaf springs.

9. In an alarm electronic timepiece:

a base member, a plurality of pins extending from the base member, an alarm indicator wheel supported on the base member for rotation and having a generally inverse cone-shaped end portion, and a spring member for elastically supporting the alarm indicator wheel on the base member by an elastic force of the spring member, wherein the spring member has an arcuate portion for sliding engagement with the inverse cone-shaped end portion of the alarm indicator wheel, and a pair of holes disposed at opposite end portions of the spring member for receiving one of the pins extending from the base member to integrally connect the spring member to the base member.

10. An alarm electronic timepiece as claimed in claim 9; wherein spring member is generally strip-shaped.

11. In an alarm electronic timepiece:

a base member, a plurality of pins extending from the base member, an alarm indicator wheel supported on the base member for rotation, an indicating member integrally connected to the alarm indicator wheel for rotation therewith to indicate alarm time, and a spring member for elastically supporting the alarm indicator wheel on the base member by an elastic force of the spring member and for regulating a rotation direction of the alarm indicator wheel, the spring member having a pair of holes disposed at opposite end portions of the spring member for receiving respective ones of the pins extending from the base to integrally connect the spring member to the base member.

12. An alarm electronic timepiece as claimed in claim 11; wherein the spring member has a pair of bridge elements connecting the opposite end portions to one another, and an arcuate portion for sliding engagement with an end surface portion of the alarm indicator wheel.

13. An alarm electronic timepiece as claimed in claim 12; wherein the end surface portion of the alarm indicator wheel is generally cone-shaped.

14. An alarm electronic timepiece as claimed in claim 11; wherein the spring member has a pair of flexible arm portions extending from one of the opposite end portions, the flexible arm portions having arcuate surfaces for sliding engagement with an end surface portion of the alarm indicator wheel.

15. An alarm electronic timepiece as claimed in claim 14; wherein the end surface portion of the alarm indicator wheel is generally cone-shaped.

16. In an alarm electronic timepiece:

a base member, an alarm indicator wheel supported on the base member for rotation, an indicating member integrally connected to the alarm indicator wheel for rotation therewith to indicate alarm indicator wheel on the base member and for regulating a rotating direction of the alarm indicator wheel, and connecting means for integrally connecting the spring member to the base member, wherein the spring member has a pair of opposite end portions, and a pair of bridge elements connecting the end portions to one another and for sliding engagement with an end portion of the alarm indicating member.

17. An alarm electronic timepiece as claimed in claim 16; wherein the connecting means comprises a pair of connecting elements extending from the base member and a pair of holes each disposed at one of the opposite end portions of the spring member for receiving one of the connecting elements to integrally connect and position the spring member on the base member.

18. An alarm electronic timepiece as claimed in claim 17; wherein one of the holes disposed at one of the end portions of the spring member has a generally circular shape, and the other of the positioning holes disposed at the other end portion of the spring member has a generally elongate shape.

19. An alarm electronic timepiece as claimed in claim 16; wherein each of the bridge elements of the spring member has an arcuate portion for sliding engagement with the end portion of the alarm indicator wheel.

20. An alarm electronic timepiece as claimed in claim 19 wherein the end portion of the alarm indicator wheel is generally inverse cone-shaped.

21. An alarm electronic timepiece as claimed in claim 16; wherein the end portions and the bridge elements of the spring member form a closed hole through which the end portion of the alarm indicator wheel extends when the spring member supports the alarm indicator wheel on the base member.

22. An alarm electronic timepiece as claimed in claim 21; wherein each of the bridge elements of the spring member has an arcuate portion for sliding engagement with the end portion of the alarm indicator wheel.

23. An alarm electronic timepiece as claimed in claim 22; wherein the end portion of the alarm indicator wheel is generally inverse cone-shaped.

24. An alarm electronic timepiece as claimed in claim 23; wherein the spring member is generally strip-shaped.

25. In an alarm electronic timepiece:

a base member, an alarm indicator wheel supported on the base member for rotation, an indicating member integrally connected to the alarm indicator wheel for rotation therewith to indicate alarm time, a spring member for elastically supporting the alarm indicator wheel on the base member and for regulating a rotating direction of the alarm indicator wheel, and connecting means for integrally connecting the spring member to the base member, wherein the spring member has a pair of opposite end portions, and a pair of bridge elements connecting the end portions to one another and for sliding engagement with an end portion of the alarm indicating member.

26. An alarm electronic timepiece as claimed in claim 25; wherein the spring member has a pair of flexible arm portions extending from one of the end portions of the spring member and into the closed hole, the flexible arm portions having arcuate surfaces for sliding engagement with the end portion of the alarm indicator wheel.

27. An alarm electronic timepiece as claimed in claim 26; wherein the end portion of the alarm indicator wheel is generally inverse cone-shaped.

28. An alarm electronic timepiece as claimed in claim 26; wherein the flexible arm portions comprise leaf springs.

29. An alarm electronic timepiece as claimed in claim 25; further comprising a pair of connecting elements extending from the base member, and wherein the spring member has a pair of opposite end portions of the spring member for receiving one of the connecting elements to integrally connect and position the spring member on the base member.

30. An alarm electronic timepiece as claimed in claim 29; wherein wherein one of the holes disposed at one of the end portions of the spring member has a generally circular shape, and the other of the positioning holes disposed at the other end portion of the spring member has a generally elongate shape.

* * * * *